US005931099A

United States Patent [19]

Bruner et al.

[11] Patent Number: 5,931,099

[45] Date of Patent: Aug. 3, 1999

[54] MODEL TRAIN SET WITH STORAGE MEANS AND VARIABLE TRACK ARRANGEMENT

[75] Inventors: Dan Bruner, Powell; Keith Kresge, Worthington, both of Ohio; Norio Sujikawa, San Francisco, Calif.

[73] Assignee: Lionel LLC, Chesterfield, Mich.

[21] Appl. No.: 08/943,857

[22] Filed: Oct. 3, 1997

[51] Int. Cl.[6] ..... A63G 1/00

[52] U.S. Cl. ..... 104/53; 104/DIG. 1; 446/75; 446/447; 105/1.5; 238/10 A; 238/10 E

[58] Field of Search ..... 104/53, DIG. 1; 105/1.5; 238/10 R, 10 A, 10 B, 10 E; 446/75, 147, 447, 454

[56] References Cited

U.S. PATENT DOCUMENTS

| | | | |
|---|---|---|---|
| 1,776,262 | 9/1930 | LeNoir et al. | 238/10 A |
| 1,914,116 | 6/1933 | Ford | 238/10 A |
| 2,008,390 | 7/1935 | Harris | 238/10 A |
| 2,618,437 | 11/1952 | De Matthaeis et al. | 238/10 A |
| 3,579,904 | 5/1971 | Genin | 46/216 |
| 4,349,983 | 9/1982 | Kilroy et al. | 46/12 |
| 4,669,657 | 6/1987 | Crain et al. | 238/10 A |
| 4,898,404 | 2/1990 | Babcock | 281/15.1 |
| 4,937,207 | 6/1990 | Simmell et al. | 104/DIG. 1 |
| 5,427,561 | 6/1995 | Eichhorn et al. | 446/447 |

*Primary Examiner*—Mark T. Le
*Assistant Examiner*—Robert J. McCarry, Jr.
*Attorney, Agent, or Firm*—Rader, Fishman & Grauer PLLC

[57] ABSTRACT

A model train set includes a base member having two base member sections that are connected together in a horizontal arrangement such that an upper surface is formed. The upper surface has a continuous integral trackway disposed thereon. The model train set includes at least one snap-in reversible storyboard, having a first surface and a second surface with unique surface configurations to modify the upper surface. Further included is a plurality of visual elements which are selectively engageable with the upper surface. An array of storage recesses are provided which serve to provide storage for the visual elements. A toy train is also included.

25 Claims, 5 Drawing Sheets

Fig. 6
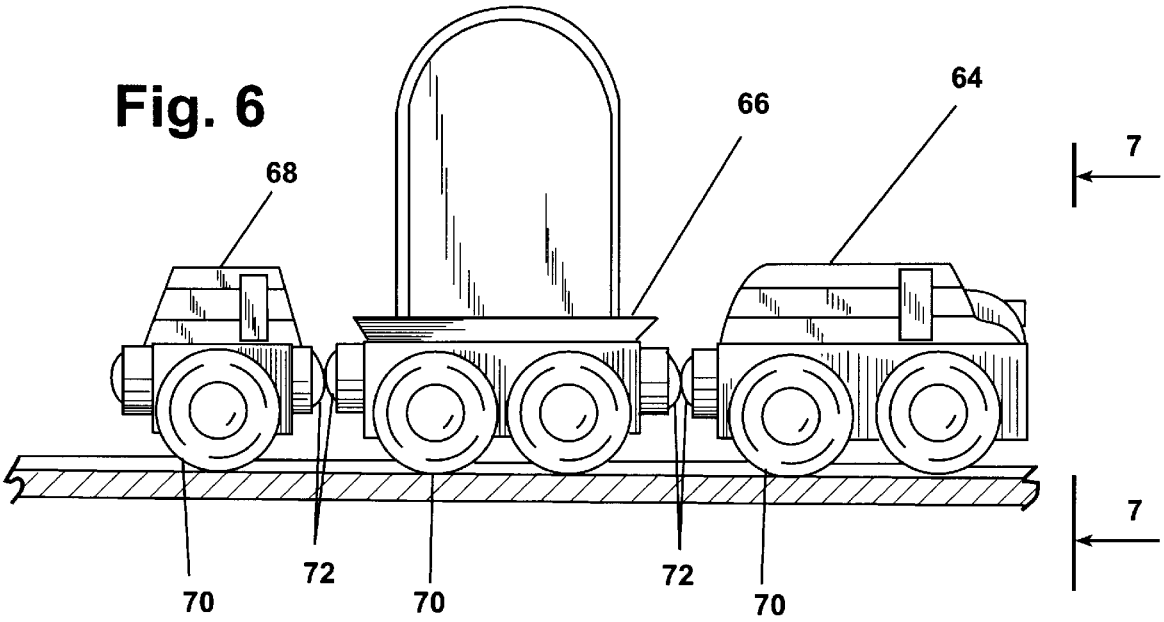
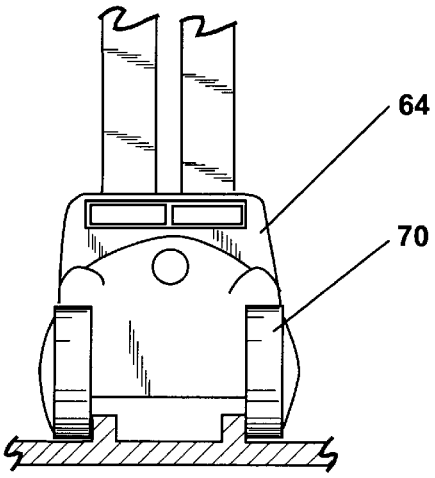
Fig. 7

MODEL TRAIN SET WITH STORAGE MEANS AND VARIABLE TRACK ARRANGEMENT

FIELD OF THE INVENTION

The present invention relates to a model train set, and more particularly to a model train set that includes a foldable base member having a trackway and a number of storage recesses. The trackway and base member surface are capable of being altered by the addition of snap-in reversible storyboards or by connecting separable trackway pieces to the base member.

BACKGROUND OF THE INVENTION

Model train sets and associated accessory items are well known and have long been a source of entertainment. Numerous structures for use with model trains have been developed over the years with a special emphasis on the track layout arrangement.

Known model train sets include rail track sections of varying configurations that interconnect to form a particular layout. By separating the sections and re-attaching them together in a different configuration, it is possible to produce a variety of track layouts. However, once a particular track layout has been created and various scenic elements have been associated and coordinated with that layout, it becomes a difficult and time-consuming task to break up the existing layout and set up a new one.

Another problem that is associated with known model train sets is that a fairly high level of skill is required to set up or modify a track layout. While model train sets are often intended for children, young children often lack the necessary ability to modify a layout by themselves and must usually enlist an adult, if one is available, to assist them. Thus, known model train sets are undesirably complicated for younger children.

To simplify track layouts, other known model train sets provide trackways in the form of channels formed in a plastic panel, the movement of a train being confined to the channels. Although the child need not enlist an adult to set up various layouts, the drawback to such an arrangement is that the layout is permanent and cannot be altered, thereby limiting the entertainment possibilities. Thus, a child's interest in the train set is quickly exhausted. While still other model train sets may provide for attachment of additional track sections to vary the peripheral track layout, the track section of the plastic panel still remains permanent.

Finally, model train sets are known which have included square boards, each board having a depressed track section that can communicate with corresponding track sections on contiguous boards to define alternate track layouts. The boards may include peg holes that can receive snap-fit scenery elements, which when positioned to straddle contiguous boards, serve to interlock them together. There are a number of drawbacks to these types of train sets. The boards are cumbersome and difficult to transport. These types of train sets also lack a storage means for the scenic elements which, because of their small size, may become lost. Further, the boards are difficult to use on carpeted or uneven surfaces because the boards may separate from each other, thereby disrupting the track layout. Additionally, the boards may slip apart if they are not properly interlocked together, making the train set difficult to use even on a substantially planar surface.

SUMMARY OF THE INVENTION

The present invention is directed to a model train set having a base member and at least one snap-in reversible storyboard.

The base member is constructed of at least two base member sections which are connected together, preferably by a hinge mechanism, such that the base member is foldable. The base member sections each have top faces which form an upper surface when the top faces are oriented in a horizontal plane. The base member is such that the upper surface may be formed even when the base member is positioned on carpet or other uneven surfaces.

The upper surface of the base member includes a continuous integral trackway, which may have variable elevations in the form of a hill or valley. Exit ramps may also be provided on the base member and along the trackway, with the ramps each having an interconnection mechanism designed to permit attachment of additional separate trackway pieces.

The snap-in reversible storyboards are adapted to matingly engage with the upper surface. The snap-in reversible storyboards have a first surface and a second surface, each surface having a unique surface configuration. The surfaces may further include a trackway section that is adapted to interconnect with the continuous integral trackway, thereby allowing for modification of the trackway. The trackway sections each have different configurations such that different trackway layouts can be produced.

The model train set may also include a plurality of visual elements which are selectively engageable to the upper surface or the reversible storyboards. Preferably, the visual elements each include a uniformly shaped tab member. The tab member is receivable in uniform slots disposed on the upper surface and the first and second surfaces of the reversible storyboards. Each of the uniformly shaped slots are adapted to receive the uniformly shaped tab members in a slip-fitengagement.

The upper surface of the base member may further include an array of storage recesses for easy storage of the visual elements. Preferably the storage recesses are of varying sizes with some of the recesses shaped to receive corresponding shaped visual elements.

Therefore, the present invention enables even young children to simply and easily produce varied track layout designs through the use of reversible storyboards and by permitting a child to add additional trackway. The present model train set also provides for ready storage of all components by means of the storage recesses as well as allowing for the base member to be folded up for ease of storage and transport. Further, due to the construction of the base member, the model train set may be used on carpet or other uneven surfaces without disrupting the continuous integral trackway.

BRIEF DESCRIPTION OF THE DRAWINGS

The features and inventive aspects of the present invention will become more apparent upon reading the following detailed description, claims, and drawings, of which the following is a brief description:

FIG. 6 is a side view of a model train in accordance with the present invention.

FIG. 7 is a front view, partially in cross-section and partially broken away to illustrate the engagement of the visual elements with the model train.

DETAILED DESCRIPTION OF THE PREFERRED EMBODIMENT

Figure 1:
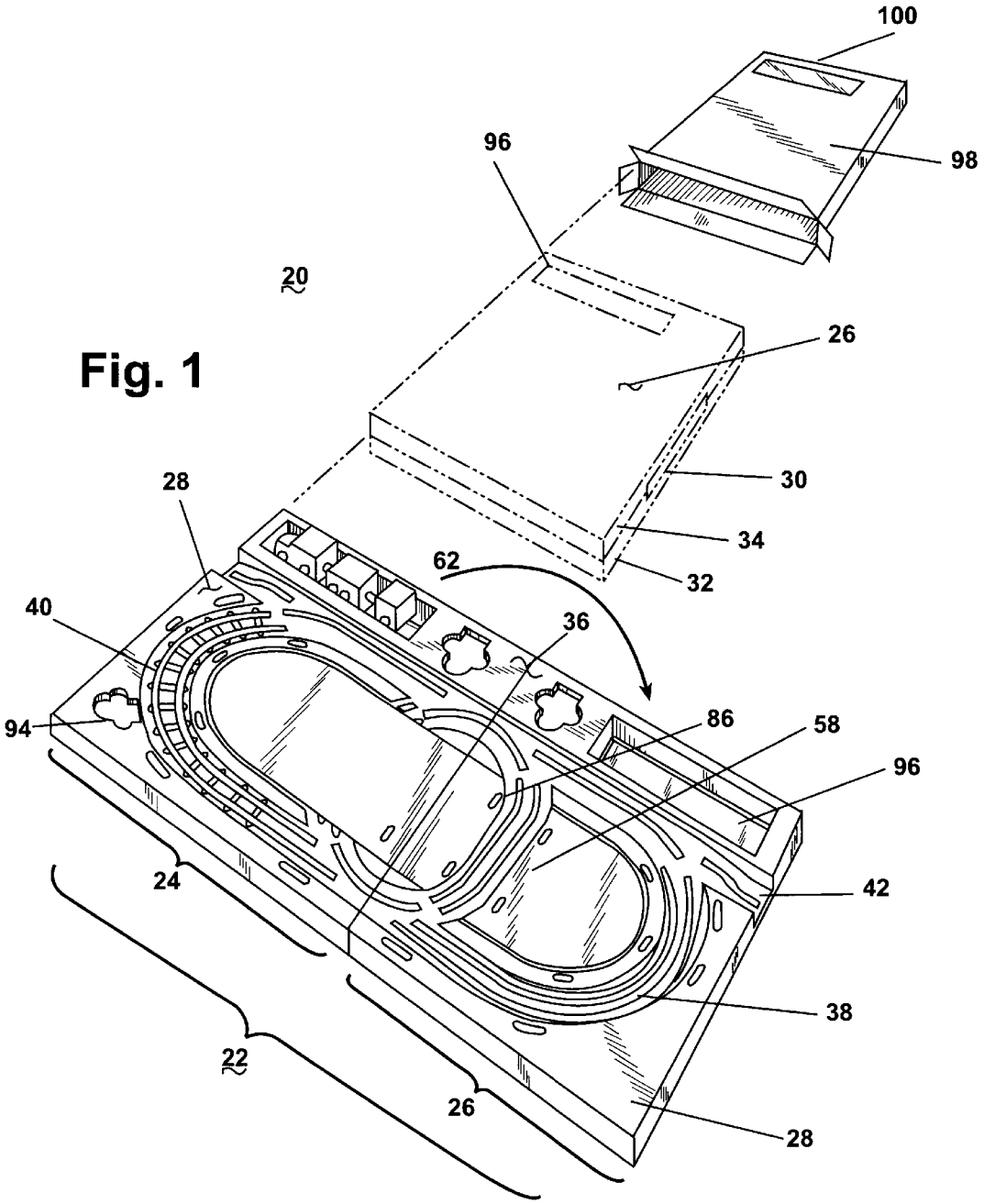
FIG. 1 is a perspective view of the model train set in accordance with the present invention.
Figure 2:
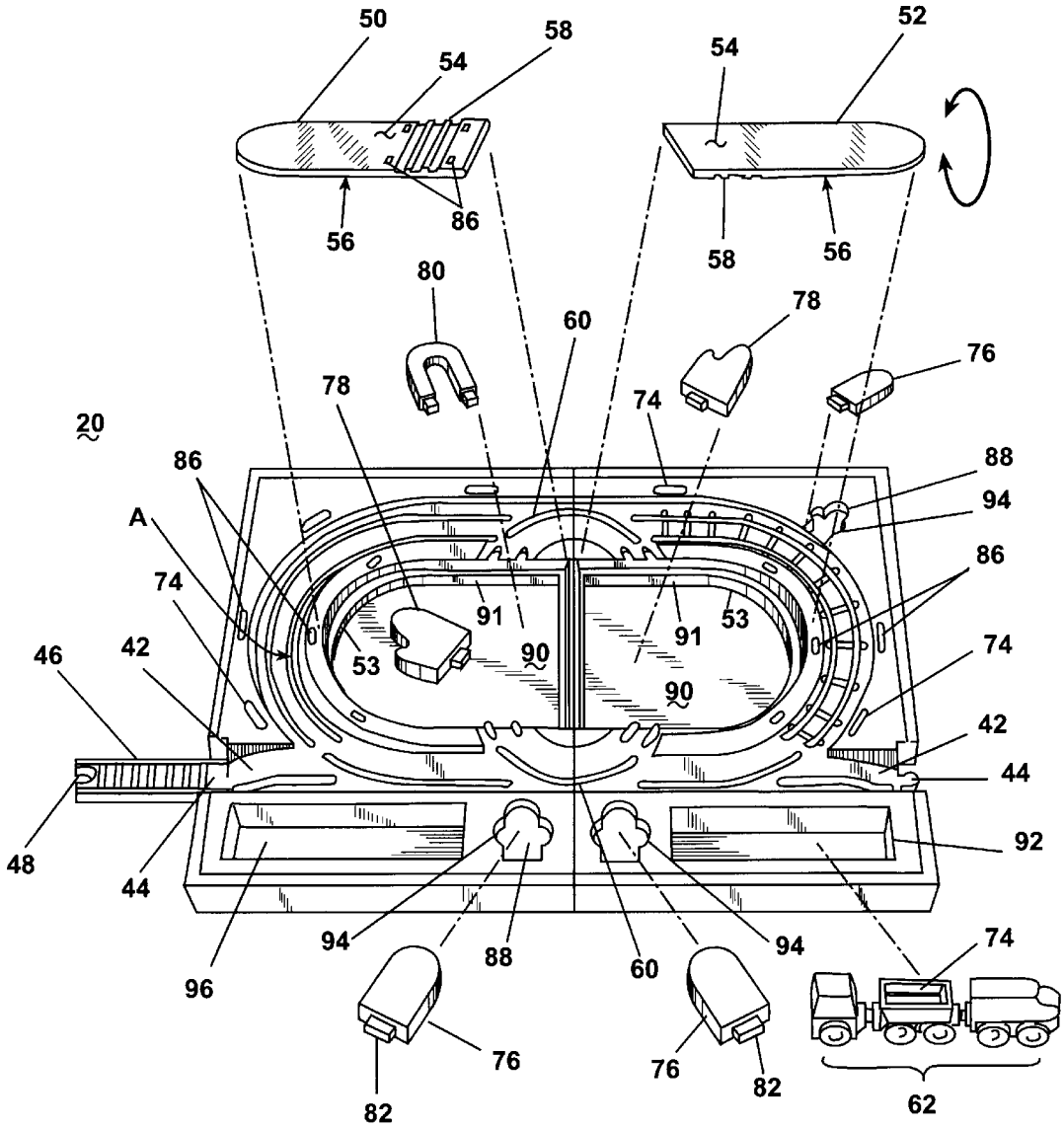
FIG. 2 is a partially exploded view of a model train set in accordance with the present invention.

FIGS. 1 and 2 feature a model train set 20 in accordance with the present invention. Model train set 20 includes a base member 22 having a first base member section 24 and a second base member section 26, each base member section having a top face 28. Base member sections 24, 26 are pivotally connected together, preferably by means of a hinge mechanism 30, located on first and second base member side walls 32 and 34. Hinge mechanism 30 allows for base member 22 to be oriented in either an open position or a storage position. The open position orients top faces 28 in a horizontal plane such that an upper surface 36 is formed. In the storage position, discussed in greater detail below, second base member section 26 is folded on top of first base member section 24 such that top faces 28 are oriented in a face-to-face engagement. Base member 22 is constructed such that it retains the open position even when base member 22 is positioned on carpet or other uneven surfaces.

Upper surface 36 has a continuous integral trackway 38 formed thereon. Continuous integral trackway 38 is formed as a generally continuous loop. It may include a section of molded railroad ties 40 for aesthetics, or have variable elevation in the form of a hill or valley, such as that shown around curve A.

Additionally, continuous integral trackway 38 may further include optional one or more exit ramps 42. As illustrated in FIG. 2, exit ramps 42 include an interconnection mechanism 44 with is engageable with a trackway piece 46 extending away from base member 22. Interconnection mechanism 44 preferably operates similar to a tongue and groove arrangement, with interconnection mechanism 44 connecting with a mating trackway portion 48 to interlock trackway piece 46 to continuous integral trackway 38.

Further included in model train set 20 are snap-in reversible storyboards 50 and 52 which are adapted to matingly engage with upper surface 36. To engage with upper surface 36, snap-in reversible storyboards 50 and 52 rest on a supporting ridge 53 which is disposed below upper surface 36, such that snap-in reversible storyboards 50 and 52 are flush with upper surface 36. Preferably, supporting ridge 53 is disposed along inside walls 91 of large storage recesses 90, discussed in greater detail below, thereby enabling snap-in reversible storyboards 50 and 52 to fit over and cover large storage recesses 90.

Snap-in reversible storyboards 50 and 52 have first and second surfaces 54 and 56, respectively. Each of the surfaces have unique surface configurations such that upper surface 36 can be modified by flipping over snap-in reversible storyboards 50 and 52 or by interchanging them. Additionally, first and second surfaces 54, 56 may also include trackway sections 58 disposed thereon, as shown in FIG. 2. Trackway sections 58 are adapted to interconnect with continuous integral trackway 38 by means of a trackway adaptation section 60. Trackway sections 58 may be of varying configurations and disposed on only one surface of snap-in reversible storyboards 50 and 52, both surfaces, or neither surface. The varied configurations of trackway sections 58 allow for alternate track layouts for model train set 20.

Model train set 20 further includes a model train 62 which is movable on a floor, in continuous integral trackway 38, along trackway pieces 46, or on trackway sections 58. FIGS. 6 and 7 depict model train 62 as having a locomotive 64, a recessed carrier car 66, and a caboose 68. Other cars, such as a tender and a passenger car, not shown, may also be provided. Each car has rotating wheels 70 that are adapted to engage continuous integral trackway 38, trackway pieces 46, and trackway sections 58 such that model train 62 can travel over the trackway. Cars 64, 66, and 68 are detachably connected together by means of magnetic couplers 72, located at either end of cars 66 and 68, and located at the rear end of car 64.

Referring now to the bottom of FIG. 2, recessed carrier car 66 will be described. Recess carrier car 66 further includes a mechanism for detachably securing at least one visual element, such as visual element 76. Preferably, the mechanism is a uniformly shaped slot 74 which is adapted to receive a uniformly shaped tab member.

Figure 3:
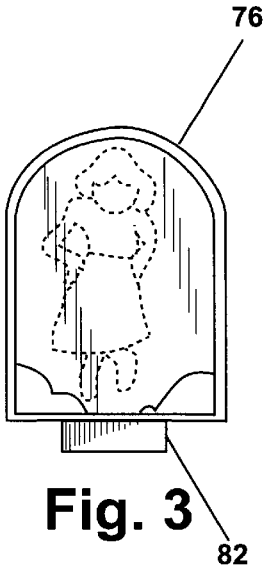
FIGS. 3–5 are front views of various visual elements in accordance with the present invention.
Figure 4:
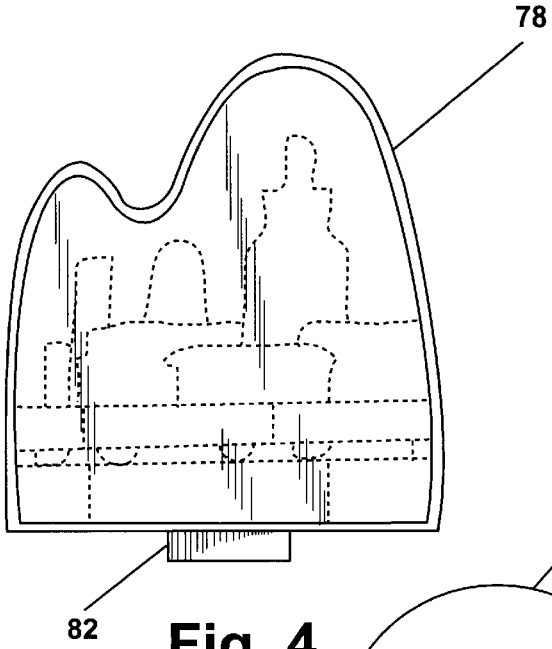
Figure 5:
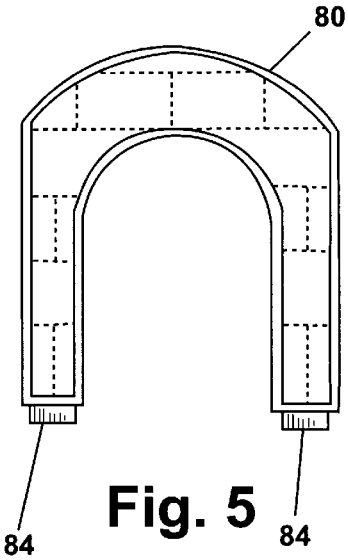
Figure 5A:
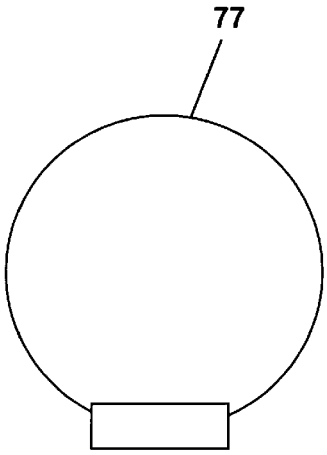
Figure 5B:
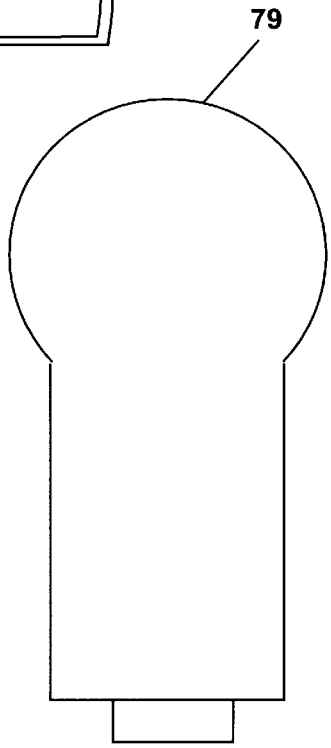

Model train set 20 also includes a plurality of visual elements 76, 77, 78, 79, and 80 which may have a variety of shapes, such as those shown in FIGS. 3–5. Each visual element is substantially of uniform thickness to allow for interchangability in storing the visual elements in various storage recesses, discussed in greater detail below.

Each visual element also includes a picture that is appended to at least one of its surfaces. The pictures may be characters, such as that seen in FIG. 3, or a scenic element such as a cityscape, as shown in FIG. 4. Appending the pictures to the visual elements serve to lower production costs as different pieces can be produced more easily than, for example, molding different designs into the visual elements.

Visual elements 76 and 78 further include a means for detachably securing the visual element to upper surface 36, first and second surfaces 54 and 56, or recessed carrier car 66. Preferably, visual elements 76 and 78 each have a uniformly shaped tab member 82 which is engageable with uniformly shaped slots 74 that are formed on upper surface 36, first and second surfaces 54 and 56, and recessed carrier car 66, as shown in FIGS. 1 and 2. Each uniformly shaped slot 74 is adapted to receive uniformly shaped tab member 82 in a slip-fitengagement. Because uniformly shaped slots 74 are dispersed throughout upper surface 36 and on first and second surfaces 54 and 56, the visual elements 76 and 78 may be placed anywhere the user pleases.

FIG. 5 features another visual element in the form of an arch. Arch element 80 has parallel tab members 84 which serve to detachably secure arch element 80 to upper surface 36 or first and second surfaces 54 and 56. Parallel tab members 84 are receivable in parallel slots 86 that are formed in upper surface 36 and first surface and second surfaces 54 and 56. Parallel slots 86 are positioned such that arch element 80 is disposed to straddle continuous integral trackway 38 or trackway sections 58 when parallel tab members 84 are engaged with parallel slots 86.

Model train set 20 further includes an array of storage recesses 88, 90, and 92 formed in upper surface 36, as shown in FIGS. 1 and 2. The array of storage recesses includes small storage recesses 88, at least one large storage recess 90, and a rectangular storage recess 92. Small storage recesses 88 are snap-fit recesses and are designed to hold visual elements 76 when not in use. Small storage recesses 88 are substantially the shape and size of visual element 76 and further include additional recessed areas which act as fingerholds 94, thereby enabling a user to disengage visual elements 76 from snap-fit small storage recesses 88 with relative ease.

Large storage recesses 90 are adapted to hold visual elements such as visual elements 77, 78, 79 and 80 when these elements are not in use. Large storage recesses 90 are substantially the shape and size of snap-in reversible storyboards 50 and 52 and further includes supporting ridge 53 disposed along inside walls 91 of large storage recesses 90. Snap-in reversible storyboards 50 and 52 are sized such that when they engage with supporting ridge 53 and are flush with upper surface 36, large storage recesses 90 are hidden from view, such as in FIG. 1.

Upper surface 36 also has rectangular storage recess 92 and a corresponding windowed recess 96 disposed thereon that are substantially the same size. Rectangular storage recess 92 is adapted to hold model train 62 when it is not in use. Windowed recess 96 has a bottom surface that is substantially transparent. When model train 62 is placed in rectangular recess 92 and base member 22 is oriented into the storage position, windowed recess 96 aligns with and fits over rectangular recess 92. In this position model train 62 is visible through the windowed recess 96.

An optional storage box 98 may also be provided such as that shown in FIG. 1, for easy storage and portability. Storage box 98 is adapted to receive base member 22 when it is in the storage position. Preferably storage box 98 has a window section 100 which corresponds to windowed recess 96, such that model train 62 may be viewed when base member 22 is in storage box 98.

Figure 8:
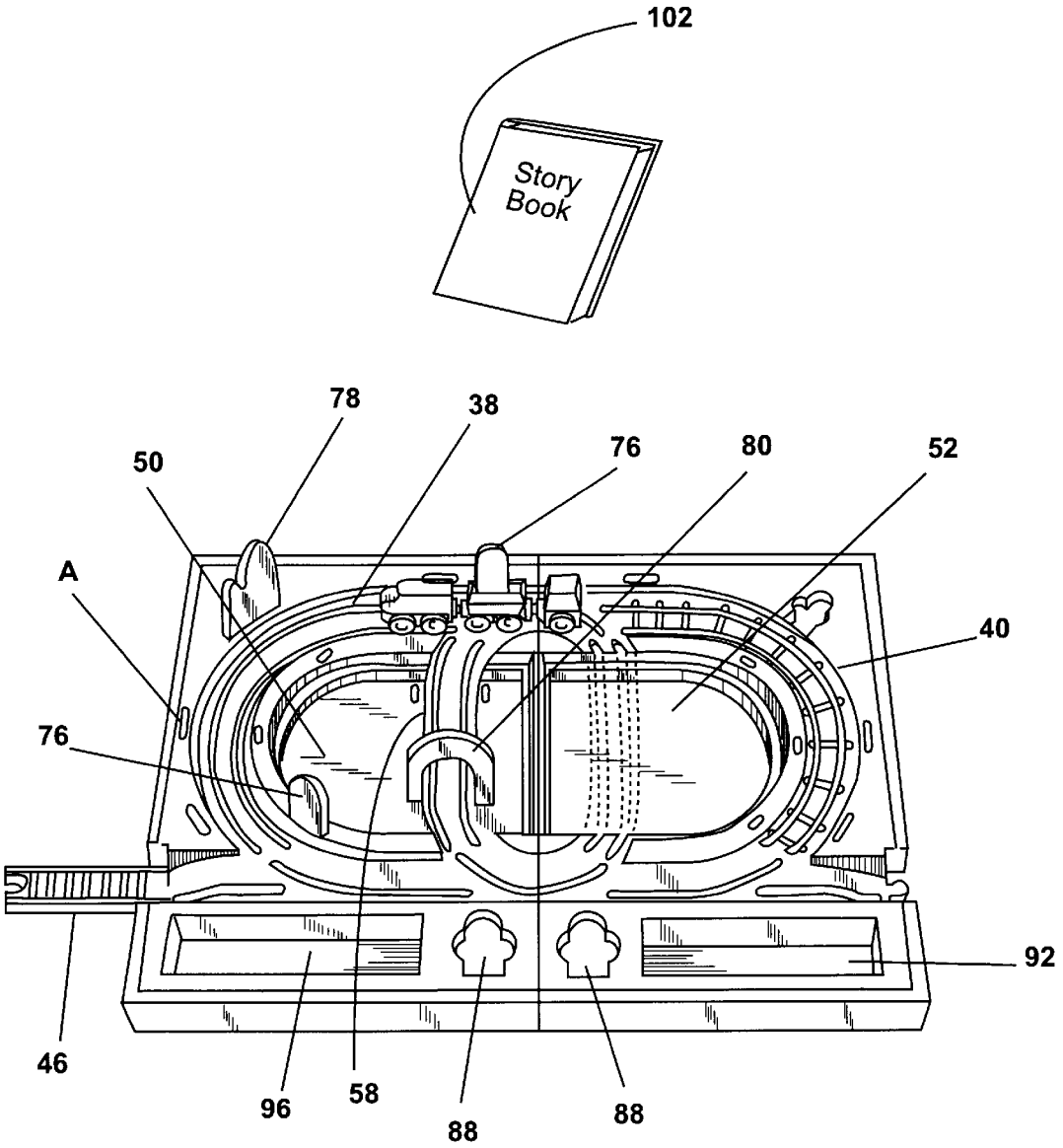
FIG. 8 is a perspective view of the play set when in use in accordance with the present invention.

Model train set 20 may also include an optional book 102 having a narrative story, as shown in FIG. 8. Book 102 may also include instructions for using model train set 20. The instructions would indicate particular trackway configurations that can be accomplished by use of snap-in reversible storyboards 50 and 52 as well as placement of visual elements 76, 77, 78, 79 and 80 to create scenes depicted in book 102. Preferably book 102 is sized such that it fits into large storage recesses 90 for easy storage.

It is contemplated that accessory sets may also be provided to complement model train set 20. The accessory sets preferably include a book having a different narrative story, at least one snap-in reversible storyboard and additional visual elements. The additional snap-in reversible storyboards and visual elements have a similar shape and size to those provided with model train set 20 to allow for interchangeabilty of the pieces.

FIG. 8 illustrates model train set 20 in use. Model train 62 is engaged with continuous integral trackway 38 and is carrying visual element 76 in recessed carrier car 66. Visual elements 76 and 78 are detachably secured to upper surface 36. Snap-in reversible storyboards 50 and 52 are oriented such that model train 62 may traverse trackway section 58 on snap-in reversible storyboard 50. Snap-in reversible storyboard 50 further includes arch element 80 detachably secured to snap-in reversible storyboard 50 and positioned to straddle trackway section 58.

The disclosed embodiments and examples are given to illustrate the present invention. However, they are not meant to limit the scope and spirit of the present invention. Therefore, the present invention should be limited only to the appended claims.

What is claimed is:

1. A model train set, comprising:

a base member having a first base member section and a second base member section, each base member section having a top face, said first and second base member sections connected together such that said top faces form an upper surface of said base member, said upper surface having a continuous integral trackway disposed thereon; and at least one reversible storyboard having a first surface and a second surface opposing said first surface, each surface having a unique surface configuration, said reversible storyboard selectively engaging said upper surface of said base member such that said reversible storyboard mates with said upper surface;

wherein said upper surface of said base member is configured to allow said upper surface to be modified by flipping over said reversible storyboard.

2. The model train set of claim 1, wherein at least said second surface of said reversible storyboard has an integral trackway section, said integral trackway section interconnectable with said continuous integral trackway of said upper surface of said base member when said reversible storyboard is flipped with said second surface being in mating engagement with said upper surface to selectively vary the trackway configuration of said continuous integral trackway on said base member.

3. The model train set of claim 1, further including a plurality of visual elements, each of said visual elements selectively engageable with said upper surface of said base member such that said visual elements may be detachably secured to said upper surface.

4. The model train set of claim 3, further including a model train movable in said continuous integral trackway, said model train having a car, said visual elements selectively engageable with said car such that said visual elements may be detachably secured to said car.

5. The model train set of claim 3, further including an arch visual element selectively engageable with said upper surface of said base, such that said arch visual element is disposed to straddle said continuous integral trackway when said arch visual element is engaged with said upper surface of said base member.

6. The model train set of claim 5, wherein said arch visual element selectively engageable with said first and second surfaces of said reversible storyboard which have said integral trackway sections, said arch visual element disposed to straddle said integral trackway section when said arch visual element is engaged with said first or second surface of said reversible storyboard.

7. The model train set of claim 3, further including an instruction book, wherein said instruction book includes a narrative story having instructions for positioning said reversible storyboards and said visual elements.

8. The model train set of claim 3, wherein said upper surface includes at least one storage recess disposed thereon for receiving said visual elements when said visual elements are not secured to said base member, wherein said reversible storyboard selectively covers at least one of said storage recesses when said reversible storyboard is engaged with said upper surface.

9. The model train set of claim 1, wherein said continuous integral trackway is of variable elevation.

10. The model train set of claim 9, wherein said continuous integral trackway includes at least one exit ramp, said exit ramp interconnectable with separable trackway sections extending away from said base member.

11. The model train set of claim 1, wherein said first and second base member sections are pivotally connected such that said second base member section may be folded on top of said first base member section such that said top faces are oriented in a face-to-face engagement.

12. The model train set of claim 11, further including a storage box adapted to receive said base member when said top faces are oriented in said face-to-face engagement.

13. A model train set, the combination comprising:

a base member having a first base member section and a second base member section, each base member section having a top face, said first and second base member sections connect together such that said top faces form an upper surface, said upper surface having a continuous integral trackway, an array of storage recesses, and a plurality of uniformly shaped slots disposed thereon;

a plurality of visual elements, said visual elements receivable into said array of storage recesses for storage, each of said visual elements further including a uniformly shaped tab member which is receivable in said uniformly shaped slots such that said visual elements may be detachably secured to said upper surface when not in storage; and at least one reversible storyboard having a first surface and a second surface, each surface having a unique surface configuration, said reversible storyboard selectively covers at least one of said storage recesses.

14. The model train set of claim 13, wherein at least said second surface further including an integral trackway section, said integral trackway section interconnectable with said continuous integral trackway of said upper surface of said base member when said reversible storyboard is flipped with said second surface being in mating engagement with said upper surface to selectively vary the trackway configuration of said continuous integral trackway on said base member.

15. The model train set of claim 14, said first and second surfaces further including at least one uniformly shaped slot disposed thereon, said uniformly shaped slot adapted to receive said uniformly shaped tab member of said visual elements.

16. The model train set of claim 14, further including an arch visual element having two parallel tab members receivable in parallel slots formed on said upper surface, said parallel slots being disposed to straddle said continuous integral trackway.

17. The model train set of claim 15, further including an arch visual element having two parallel tab members receivable in parallel slots disposed on said first and second surfaces of said reversible storyboard which have said integral trackway sections, said parallel slots being disposed to straddle said integral trackway sections.

18. The model train set of claim 17, further including a model train movable in said continuous integral trackway, said model train having a car, said visual elements selectively engageable with said car such that said visual elements may be detachably secured to said car.

19. The model train set of claim 18, further including an instruction book, wherein said instruction book includes a narrative story having instructions for positioning said reversible storyboard, said visual elements, and said arch visual element.

20. The model train set of claim 13, wherein said array of storage recesses includes a train storage recess and a windowed recess.

21. The model train set of claim 20, wherein said first and second base member sections are pivotally connected such that said second base member section may be folded on top of said first base member section with said top faces being oriented in a face-to-face engagement, said windowed recess being disposed on top of said train storage recess such that said model train may be viewed through said windowed recess when said model train is in said train storage recess and said top faces are in said face-to-face engagement.

22. The model train set of claim 21, further including a storage box adapted to receive said base member when said top faces are oriented in said face-to-face engagement, said storage box having a window adapted to correspond to said windowed recess such that said model train may be viewed when said base member is in said storage box.

23. A model train set, comprising;

a base member having a first base member section and a second base member section, each base member section having a top face, said first and second base member sections pivotally connected together such that said base member may be oriented in one of two positions, an open position or a storage position, said open position having said top faces oriented in a horizontal plane such that an upper surface is formed, said upper surface having a continuous integral trackway, an array of storage recesses, and a plurality of uniformly shaped slots disposed thereon, said storage position having said second base member section folded on top of said first base member section with said top faces being oriented in a face-to-face engagement;

a plurality of visual elements adapted to be receivable into said array of storage recesses for storage, each of said visual elements further including a uniformly shaped tab member which is receivable in said uniformly shaped slots such that said visual elements may be detachably secured to said upper surface when not in storage; at least one reversible storyboard having a first surface and a second surface, each surface having a unique surface configuration, said reversible storyboard adapted to cover at least one of said storage recesses and engage with said upper surface of said base member in a mating engagement, at least said second surface further including an integral trackway section disposed thereon, said integral trackway section interconnectable with said continuous integral trackway when said reversible storyboard is flipped with said second surface being in mating engagement with said upper surface of said base member; and a model train movable along said continuous integral trackway, said model train including a recessed car having at least one of said uniformly shaped slots disposed therein, said slot capable of receiving said uniformly shaped tab members of said visual elements, said model train receivable in one of said storage recesses; and a storage case adapted to receive said base member section when said base member section is in said storage position.

24. The model train set of claim 23, wherein said base member further includes a supporting ridge formed in said upper surface so as to be disposed below said upper surface, said reversible storyboards resting on said supporting ridge such that said reversible storyboard is flush with said upper surface.

25. The model train set of claim 23, wherein said upper surface includes an array of snap-fit storage recesses disposed thereon for receiving said visual elements when said visual elements are not detachably secured to said upper surface, said snap-fit storage recesses having sizes and shapes that substantially correspond to the size and shape of said visual elements.

* * * * *